US006679401B2

(12) United States Patent
Bloc

(10) Patent No.: US 6,679,401 B2
(45) Date of Patent: Jan. 20, 2004

(54) SINGLE-NOZZLE DEVICE FOR SELECTIVELY DISPENSING TWO PRODUCTS

(75) Inventor: Richard Bloc, Crosville-sur-Scie (FR)

(73) Assignee: Rexam Dispensing Systems (FR)

( * ) Notice: Subject to any disclaimer, the term of this patent is extended or adjusted under 35 U.S.C. 154(b) by 0 days.

(21) Appl. No.: 10/363,253

(22) PCT Filed: Sep. 7, 2001

(86) PCT No.: PCT/FR01/02780

§ 371 (c)(1),
(2), (4) Date: Mar. 7, 2003

(87) PCT Pub. No.: WO02/20170

PCT Pub. Date: Mar. 14, 2002

(65) Prior Publication Data

US 2003/0173377 A1 Sep. 18, 2003

(51) Int. Cl.[7] ..... B67D 5/52
(52) U.S. Cl. ..... 222/135; 222/144.5; 222/162
(58) Field of Search ..... 222/135, 162, 222/144.5, 325

(56) References Cited

U.S. PATENT DOCUMENTS 3,596,802 A * 8/1971 Feldman ..... 222/135
4,006,841 A * 2/1977 Alticosalian ..... 222/144.5

* cited by examiner

*Primary Examiner*—Philippe Derakshani
(74) *Attorney, Agent, or Firm*—Bacon & Thomas, PLLC

(57) ABSTRACT

The invention relates to a device for selectively dispensing different liquids (I, II) from a single item of packaging containing a plurality of independent reservoirs ($R_1$, $R_2$), each reservoir having a drawing-off member ($P_1$, $P_2$) equipped with a dispensing head (11, 12) and suitable for being actuated by relative movement of said head, said device being characterized in that it comprises a central housing (1) supporting the reservoirs ($R_1$, $R_2$) peripherally and movably relative to the associated dispensing heads (11, 12) secured to or integral with said housing (1), and including a selective locking key (2) for selectively locking said reservoirs in positions in which they are fixed relative to said heads (11, 12).

14 Claims, 4 Drawing Sheets

SINGLE-NOZZLE DEVICE FOR SELECTIVELY DISPENSING TWO PRODUCTS

The present invention relates to a device for selectively dispensing different liquids.

More precisely, the invention relates to selectively dispensing different liquids separately or jointly from a single item of packaging containing a plurality of independent reservoirs.

Known dispensers generally comprise a reservoir equipped, in particular, with a drawing-off member of the pump or valve type for drawing off the liquid, which member is provided with a spray head suitable for being actuated by being pressed by hand.

Devices exist that make it possible to dispense different liquids packaged in a common unit containing a plurality of independent reservoirs, but each liquid is dispensed separately by pressing on a button that is specific to it, and that acts on the corresponding head.

Those devices are thus not ergonomic, and they do not offer the possibility of dispensing liquids separately or simultaneously, without any risk of interference.

In addition, those devices do not make it possible to program various dispensing modes.

An object of the present invention is to solve those technical problems satisfactorily.

The invention achieves this object by means of a device of the preceding type, characterized in that it comprises a central housing supporting the reservoirs peripherally and movable relative to the associated dispensing heads secured to or integral with said housing, and including a selective locking key for selectively locking said reservoirs in positions in which they are fixed relative to said heads.

According to an advantageous characteristic, each reservoir includes a locking rod extending inside said housing, and whose free end forms an abutment for the locking key.

In a variant, the locking key is constituted by a rotary pin extended longitudinally by an adjustment knob and radially by lugs whose side edges are suitable for coming into contact with the locking rod of one or more of said reservoirs simultaneously by means of said pin being turned.

According to another characteristic, each reservoir includes at least one guide cavity in which a return spring is housed and which slidably receives a projecting positioning element carried by another reservoir.

In a specific variant, said heads are carried by a transverse wall forming a spacer for the reservoirs.

Preferably, said locking key is mounted in a cutout in said transverse wall.

According to yet another characteristic, said dispensing heads are connected to discharge ducts opening out into at least one nozzle carried by said housing.

In a particular variant, the walls of the reservoirs that are adjacent to the housing include respective peripheral engagement zones which are in sliding contact with the inside wall of the housing.

In another variant, the reservoirs are provided with bushes into which the drawing-off members are fixed.

In a preferred embodiment, the central housing is disposed between two reservoirs that form push buttons, namely a bottom reservoir and a top reservoir.

In a variant, the top reservoir has a bush that is longer than the bush of the bottom reservoir so as to enable the drawing-off member to operate in the upside down position.

In another embodiment, said locking key is provided with three lugs, two of which are diametrically opposite each other, and two of which are adjacent to each other.

Preferably, the two adjacent lugs have thicknesses that are substantially equal and that correspond to one half of the thickness of the opposite lug.

Advantageously, the two adjacent lugs define a notch in the vicinity of the pin for allowing the end of one of the locking rods to move radially.

The device of the invention makes it simple and effective to perform programming and to implement various dispensing modes.

The device of the invention has an outside appearance that is symmetrical and thus particularly aesthetically pleasing, in which each of the reservoirs ergonomically performs the dual function of container and of actuator in the manner of a push button.

The invention will be better understood on reading the following description given with reference to the accompanying drawings, in which.

Figure 3B:
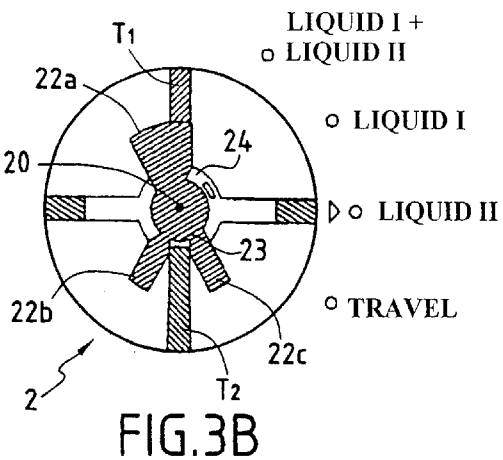
Figure 5B:
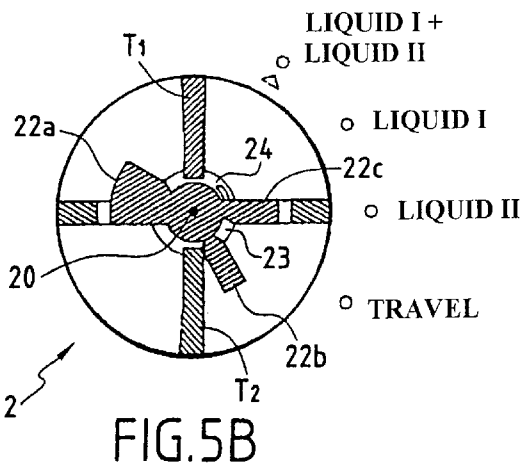
Figure 4B:
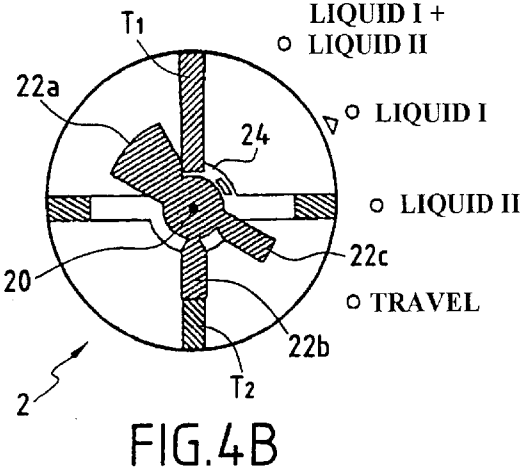
Figure 5A:
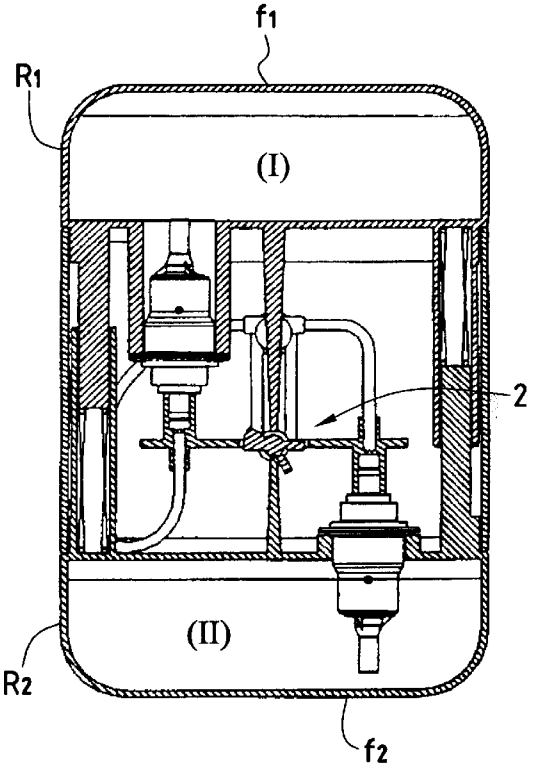
Figure 4A:
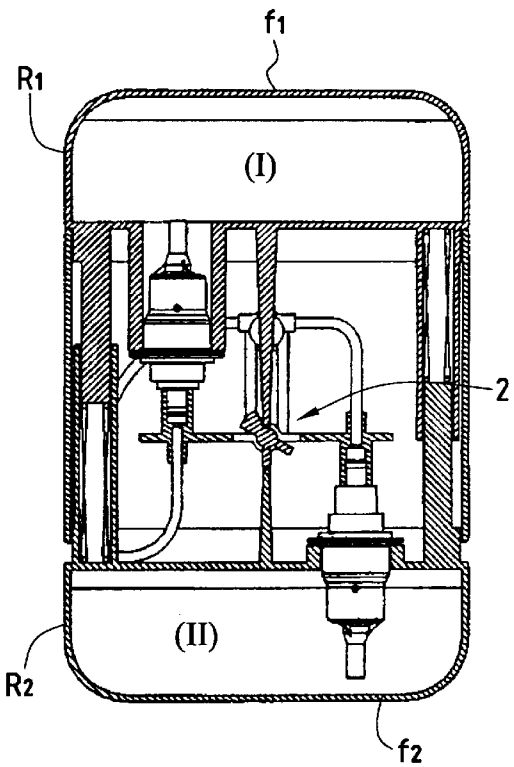
Figure 3A:
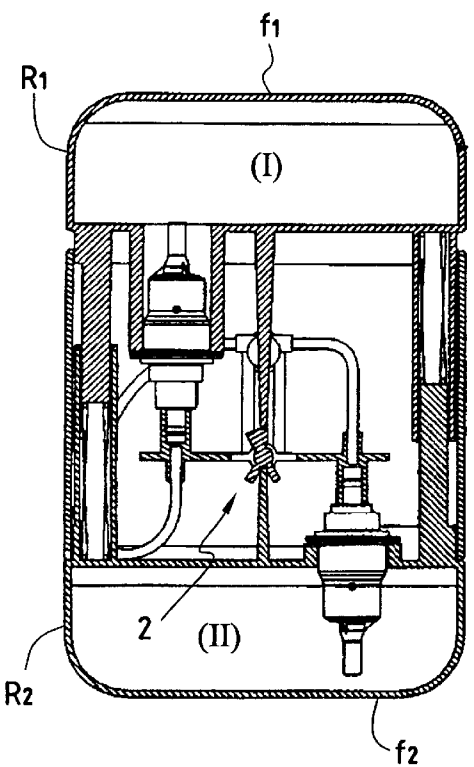

FIGS. 3A, 4A, and 5A are front section views of the device of the preceding figures respectively during the stage in which liquid I is dispensed, during the stage in which liquid II is dispensed, and during the stage in which the two liquids I+II are dispensed simultaneously; and FIGS. 3B, 4B, and 5B are detail views in section through the selective locking key in respective ones of the positions corresponding to the various dispensing stages of FIGS. 3A, 4A, and 5A.

The device shown in the figures is designed to enable different liquids to be dispensed selectively from a single item of packaging.

The item of packaging comprises a plurality of independent reservoirs which, in the embodiments shown and described below, are limited to two reservoirs, namely a top reservoir $R_1$ and a bottom reservoir $R_2$. The bottom reservoir $R_2$ serves as a base for the packaging.

However, the device of the invention could also apply to packaging comprising more than two reservoirs.

Each of the reservoirs $R_1$, $R_2$ carries a drawing-off member for drawing off the liquid that it contains.

The drawing-off member is, in this example, constituted by a conventional precompression pump $P_1$, $P_2$.

Each of the pumps $P_1$, $P_2$ is provided with a spray tube whose end that is inside the body of the pump, and that is not shown, is associated with a piston serving to put the liquid under pressure and urged resiliently upwards by a return spring.

Each pump is therefore actuated by pressing by hand on the spray tube via a dispensing head overlying said tube.

It is thus the relative movement, and more precisely the bringing together of the pump $P_1$, $P_2$ and of the associated head that causes the liquid to be discharged under pressure.

The reservoirs $R_1$, $R_2$ are provided with bushes $C_1$, $C_2$, into which the bodies of the pumps $P_1$, $P_2$ are fixed. The top reservoir $R_1$ is provided with a bush $C_1$ that is longer than the bush $C_2$ of the bottom reservoir $R_2$, so as to enable the pump $P_1$ to operate upside down.

The device of the invention comprises a central housing 1 supporting the reservoirs $R_1$, $R_2$ peripherally and movably relative to the associated dispensing heads 11, 12 which are secured to the housing 1 by being carried by a transverse wall 13 forming a spacer for the reservoirs. The heads 11, 12 are also connected to discharge ducts 110, 120 that open out into at least one spray nozzle 3 mounted on the wall of the housing 1.

Since the bodies of the pumps $P_1$, $P_2$ are fixed relative to the reservoirs $R_1$, $R_2$, one of said reservoirs, e.g. $R_1$, moving into the housing 1 by means of the pusher-forming end wall $F_1$ being pressed by hand results in the spray tube being pushed in into abutment against the head 11, and causes the metered quantity or "dose" of liquid I contained in the body of the pump $P_1$ to be put under pressured and discharged.

The device of the invention further includes a selective locking key 2 for selectively locking the reservoirs $R_1$, $R_2$ in positions in which they are fixed relative to the dispensing heads 11, 12. Each reservoir $R_1$, $R_2$ is provided with a locking rod $T_1$, $T_2$ extending inside the housing 1 and whose free end forms an abutment for the locking key 2.

The key 2 is constituted by a rotary pin 20 extending longitudinally by an adjustment knob 21 and radially by lugs 22 whose side edges can, by means of the pin 20 being turned, be caused to come into contact with the locking rod $T_1$, $T_2$ of one or more reservoirs $R_1$, $R_2$ simultaneously. The pin 20 is mounted in a cutout 10 in the transverse wall 13 that supports the dispensing heads 11, 12, while said pin 20 is received through an opening 14 provided in the sidewall la of the housing 1.

Each reservoir $R_1$, $R_2$ is provided with at least one cavity $K_1$, $K_2$ which, in this example, is implemented in the form of a cylindrical sleeve in which a return spring $S_1$,$S_2$ is received.

Each of the cavities $K_1$, $K_2$ slidably receives a projecting element $A_1$, $A_2$ of matching dimensions carried by the facing other reservoir.

The cavities $K_1$, $K_2$ co-operating with the elements $A_1$, $A_2$ positions and guides the reservoirs $R_1$, $R_2$ relative to each other and also relative to the central housing 1.

In addition, the walls of the reservoirs $R_1$, $R_2$ adjacent to the housing 1 include respective peripheral zones $r_1$, $r_2$ engaged without radial clamping into the housing 1, and coming into sliding contact with the inside wall of the housing as said walls move.

The zone $r_1$, $r_2$ co-operates with the outside portion of the reservoir $R_1$, $R_2$, all around its periphery to define an abutment-forming shoulder.

Figure 1A:
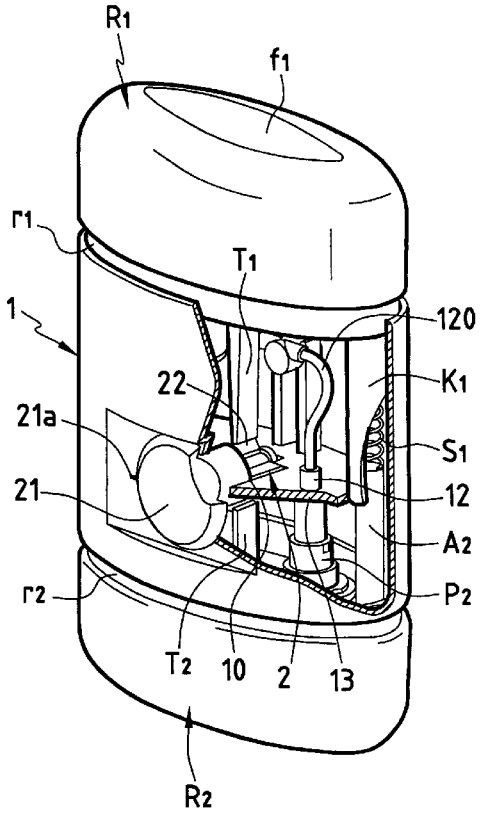
FIG. 1A is a perspective view of an embodiment of the device of the invention, shown partially cutaway in the assembled position.
Figure 1B:
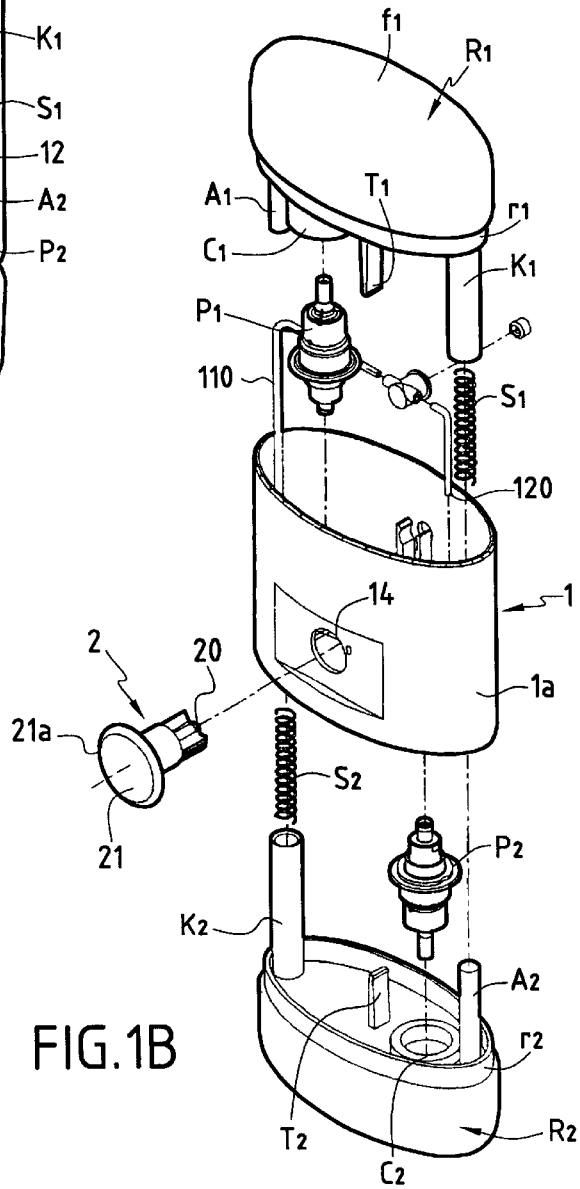
FIG. 1B is an exploded perspective view of the device of FIG. 1A.
Figure 2C:
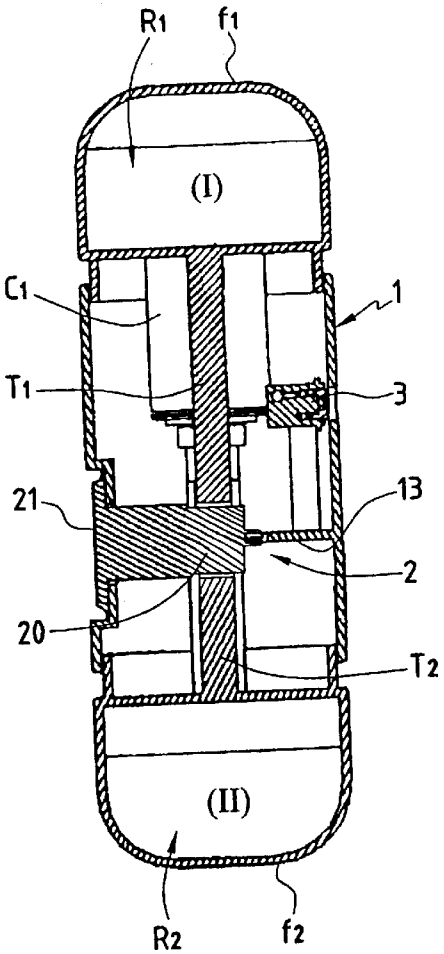
FIGS. 2A and 2C are respectively a front section view and a side section view of the device of FIGS. 1A and 1B, in the rest position.
Figure 2A:
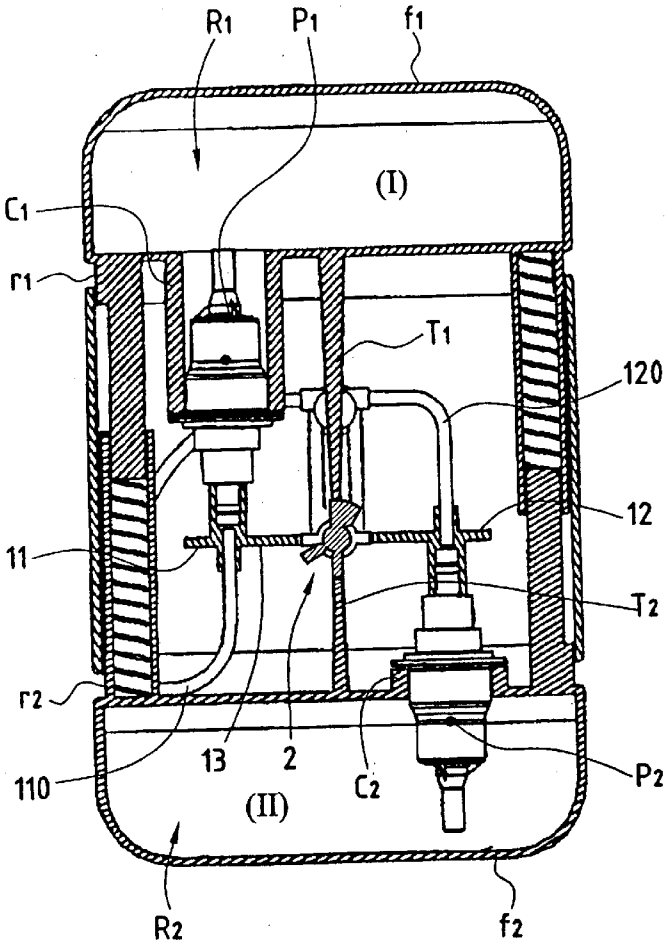
Figure 2B:
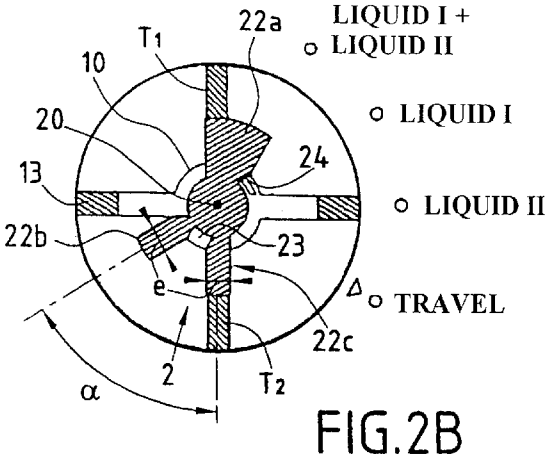
FIG. 2B is a detail view in section through the selective locking key, in the rest position.

The device of the invention is shown in the rest position in FIGS. 2A, 2B, and 2C.

In this position, the key 2 locks the locking rods $T_1$, $T_2$ of the two reservoirs $R_1$, $R_2$ by preventing them from undergoing any movement.

In this situation, any actuation of the pumps $P_1$, $P_2$ is impossible.

As shown in FIG. 2B, the locking key 2 is provided with three lugs 22*a*, 22*b*, and 22*c* in this example.

The two lugs 22*a* and 22*c* are diametrically opposite about the pin 20. The two adjacent lugs 22*b*, 22*c*, i.e. those whose relative angular distance $\alpha$ is the smaller, have thicknesses e that are substantially equal and that correspond to at least the thickness of the locking rods $T_1$, $T_2$ so as to have abutment faces that guarantee stable bearing contact.

The third lug 22*a* has a thickness that is twice the thickness of the mutually opposite lugs 22*b*, 22*c* so as to maintain one abutment face in contact with the rod $T_1$ in spite of the pin 20 being turned through an angle $\alpha$ corresponding to the angular gap between the two adjacent lugs 22*b* and 22*c*.

The two adjacent lugs 22*b*, 22*c* define a notch 23 between them in the vicinity of the pin 20. By means of its dimensions, the notch allows the end of one of the locking rods, namely the rod $T_2$ (see FIG. 3B) in this example, to move radially.

Similarly, the respective bases of the lug 22*a* and of the lug 22*b* have respective small faces 24 that are set back while also allowing the ends of the rods $T_1$ and $T_2$ to pass, thereby making it possible to limit the turning of the key 2.

In the embodiment shown, the amplitude of the angular movement of the key 2 between the respective positions of FIGS. 2B and 5B is about 90°.

In the position shown in FIGS. 3A and 3B, the key 2 is positioned to enable only liquid II to be dispensed. The programming is performed manually by turning the knob 21 and by putting the arrow mark 21*a* in register with the indication of the desired dispensing mode.

In this position, the rod $T_1$ of the reservoir $R_1$ is held stationary by being put into abutment against the end of the lug 22*a*. As a result, it is impossible to actuate the pump $P_1$.

Only the rod $T_2$ of the reservoir $R_2$ can move radially between the adjacent lugs 22*b*, 22*c* until it comes into abutment against the end wall of the notch 23.

Pressing on the end wall $F_2$ of the reservoir $R_2$ of liquid II thus actuates the pump $P_2$ which then delivers into the dispensing head 12.

In the position shown in FIGS. 4A and 4B, the knob 21 programs dispensing of liquid I only.

Only the rod $T_1$ can move radially towards the pin 20 by means of the end wall $F_1$ of the reservoir $R_1$ of liquid I being pressed by hand.

In the position shown in FIGS. 5A and 5B, the knob 21 programs joint and optionally simultaneous dispensing of the two liquids I and II.

The two rods $T_1$, $T_2$ are free to move radially towards the pin 20.

It is possible to provide a small amount of clearance between the ends rods $T_1$,$T_2$ and the abutment faces of the lugs 22 when the key 2 is in the locking position, but said clearance is in all cases less than the stroke necessary and sufficient to actuate the pumps $P_1$, $P_2$.

What is claimed is:

1. A device for selectively dispensing different liquids (I, II), the device comprising a housing and respective reservoirs ($R_1$, $R_2$), each reservoir having a drawing-off member ($P_1$, $P_2$) co-operating with a dispensing head (11, 12) wherein said reservoirs ($R_1$, $R_2$) are arranged peripherally relative to said housing and are movably mounted relative thereto, in that said housing carries said dispensing heads (11, 12) via which said drawing-off members are actuated and a locking key (2) for selectively locking said reservoirs, such a drawing-off member being actuated by relative displacement between a corresponding reservoir and said housing under the control of said locking key.

2. The device according to claim 1, wherein each reservoir ($R_1$, $R_2$) includes a locking rod ($T_1$, $T_2$) extending inside said housing (1), and whose free end forms an abutment co-operating with the locking key (2).

3. The device according to claim 2, wherein said locking key (2) is constituted by a rotary pin (20) extended longitudinally by an adjustment knob (21) and radially by lugs (22) the side edges of such a lug being suitable for coming into contact with an above-mentioned locking rod for at least one predetermined position of said locking key, so as to cause the selective locking of one or more corresponding reservoirs.

4. The device according to claim 1, wherein each reservoir ($R_1$, $R_2$) includes at least one guide cavity ($K_1$, $K_2$) in which a return spring ($S_1$, $S_2$) is housed and which slidably receives a projecting positioning element ($A_1$, $A_2$) carried by another reservoir.

5. The device according to claim 1, wherein said heads (11, 12) are carried by a transverse wall (13) forming a spacer for the reservoirs ($R_1$, $R_2$).

6. The device according to claim 5, wherein said locking key (2) is mounted in a cutout (10) in said transverse wall (13).

7. The device according to claim 1, wherein said dispensing heads (11, 12) are connected to discharge ducts (110, 120) opening out into at least one nozzle (3) carried by said housing (1).

8. The device according to claim 1, wherein the walls of the reservoirs ($R_1$, $R_2$) that are adjacent to the housing include respective peripheral engagement zones ($r_1$, $r_2$) which are in sliding contact with the inside wall of the housing (1).

9. The device according to claim 1, wherein said reservoirs ($R_1$, $R_2$) are provided with bushes ($C_1$, $C_2$) into which the drawing-off members ($P_1$, $P_2$) are fixed.

10. The device according to claim 1, wherein the central housing (1) is disposed between two reservoirs ($R_1$, $R_2$) that form push buttons, namely a bottom reservoir ($R_2$) and a top reservoir ($R_1$).

11. The device according to claim 9, wherein the top reservoir ($R_1$) has a bush ($C_1$) that is longer than the bush ($C_2$) of the bottom reservoir ($R_2$) so as to enable the drawing-off member ($P_1$) to operate in the upside down position.

12. The device according to claim 3, wherein said locking key (2) is provided with three lugs (22*a*, 22*b*, 22*c*), two of which (22*a*, 22*c*) are diametrically opposite each other, and two of which are adjacent to each other.

13. The device according to claim 12, wherein the two adjacent lugs (22*b*, 22*c*) have thicknesses that are substantially equal and that correspond to one half of the thickness of the opposite lug (22*a*).

14. The device according to claim 13, wherein the two adjacent lugs (22*a*, 22*c*) define a notch (23) in the vicinity of the pin (20) for allowing the end of one of the locking rods ($T_1$, $T_2$) to move radially.

* * * * *